US007228652B2

(12) United States Patent
Howard

(10) Patent No.: US 7,228,652 B2
(45) Date of Patent: Jun. 12, 2007

(54) LABELED KEY TAGS

(76) Inventor: Raymond Howard, 7890 Dunbrook Rd., San Diego, CA (US) 92126

( * ) Notice: Subject to any disclaimer, the term of this patent is extended or adjusted under 35 U.S.C. 154(b) by 0 days.

(21) Appl. No.: 11/345,086

(22) Filed: Jan. 31, 2006

(65) Prior Publication Data

US 2006/0150455 A1 Jul. 13, 2006

Related U.S. Application Data

(62) Division of application No. 10/627,021, filed on Jul. 25, 2003.

(51) Int. Cl.
*A44B 15/00* (2006.01)

(52) U.S. Cl. ..... 40/634; 40/638

(58) Field of Classification Search ..... 40/323, 40/633, 634, 653
See application file for complete search history.

(56) References Cited

U.S. PATENT DOCUMENTS

| | | | | | |
|---|---|---|---|---|---|
| 653,267 | A * | 7/1900 | Short | 40/634 |
| 944,744 | A * | 12/1909 | Pine | 40/323 |
| 964,228 | A * | 7/1910 | Fowler | 40/634 |
| 1,505,838 | A * | 8/1924 | Withrow | 40/634 |
| 1,711,736 | A * | 5/1929 | Lorber | 40/634 |
| 1,714,421 | A * | 5/1929 | Goldworthy | 40/634 |
| 2,181,796 | A * | 11/1939 | Williams, Jr. | 40/634 |
| 2,357,641 | A * | 9/1944 | Evalt | 40/634 |
| 2,842,877 | A * | 7/1958 | Stevens | 40/634 |
| 3,589,155 | A * | 6/1971 | Kamp | 70/459 |
| 4,235,459 | A * | 11/1980 | Callahan | 40/634 |
| 4,521,981 | A * | 6/1985 | Kasprzycki et al. | 40/634 |
| 5,617,751 | A * | 4/1997 | Song | 40/634 |
| 6,244,763 | B1 * | 6/2001 | Miller | 400/76 |

* cited by examiner

*Primary Examiner*—Lars A. Olson
(74) *Attorney, Agent, or Firm*—Hani Z. Sayed, Esq.; Rutan & Tucker, LLP

(57) ABSTRACT

A labeled key tag, key tag system and method for using the system is provided. The key tag system may be used to identify the keys that may be attached thereto. The system provides a key tag having a labeling system for downloading, printing and affixing a label to a key tag. The system allows the key tag to identifying keys on a key ring with respect to each other.

18 Claims, 2 Drawing Sheets

LABELED KEY TAGS

This application is a divisional of application Ser. No. 10/627,021 filed on Jul. 25, 2003.

FIELD OF THE INVENTION

This invention relates to the field of a key tags. More specifically, this invention relates to a key tag that may be labeled by a user to identify keys. Further, this invention relates to a key tag that is flexible and durable and allows the connection of a label to the tag.

BACKGROUND OF THE INVENTION

Today, most people carry many keys with them. For example, many people care their house keys, car keys, office keys and a variety of other different keys. Further, many organizations carry a lot of keys that have to be kept separate. For example, a realtor or agent may have several keys to different homes. A car rental agency may have keys to several different cars. An individual may also carry many outdated keys that have no function anymore. The individual may carry keys to the homes of close relatives or old residences. Many times, these individuals do not even know what the key will open. Individuals do not want to waste time and money trying to determine the function of a particular key might be, therefore, rapid identification of various keys is advantageous.

Most people keep their keys on a key ring for safekeeping and for identification. Most people keep a variety of different keys on their key ring at any given time. For example, many individuals keep a car key, a house key, and office key and several other keys on their key ring at a time. Many times, people build up a mass of keys because they start retaining keys that serve different purposes. A person may, for example, retain a key for a loved one's house and/or car. Further, a person may also possess on their key rings, keys for lockers, bicycles and boats.

It has been known in the art to keep keys on key rings that have key tags to identify the keys on the ring. Prior art key tags are typically made of a solid metal outer ring which holds in place a circular paper or cardboard inner area. The paper or cardboard inner area is kept blank and filled in by the user. The user may write on the paper or cardboard inner area to identify the use and properties of the key. The problem with these prior art key rings is that they are made of paper and/or cardboard. When the tag gets wet, the paper and/or cardboard begins to degrade in nature. Further, the writing on the tag may be smeared and dirtied, such that reading the identification of the key tag becomes difficult if not impossible. Many times, over time, the paper or cardboard completely degrades or is torn away from the metal outer area completely, leaving a tag with only a metal outer area. This completely defeats the purpose of the key tag, mainly, to identify the keys on the ring.

The prior art key tags are not made to be used more than one time. Consequently, when the key tag is marked for use, it is a one time use application. As a result, once the purpose or identity of a key is superseded, the user will then have to replace the key tags often.

The prior art key tags are limited in its use because they cause a user to physically mark the key tag to identify the keys. However, many individuals have writing that is very difficult to demarcate, making identification of the keys difficult for other users.

What is needed is key tag that is flexible yet durable, and allows for identification of the keys being stored on the key ring. Further, a key tag is needed that allows for labels to be pre-formatted or custom formatted from a webpage to be downloaded and/or printed to a user's location. The labels may be downloaded, printed and applied to the key tag for use on a variety of items.

SUMMARY OF THE INVENTION

The present invention provides a key tag with a unique labeling system. More specifically, the present invention provides a key tag having a labeling system for downloading, printing and affixing a label to a key tag. The present invention provides a key tag for identifying keys on a key ring with respect to each other.

To this end, in an embodiment of the present invention, an apparatus for labeling key tags is provided. The apparatus has a key tag having a first side and a second side wherein the first side and the second side accommodate a label thereon. The apparatus also has an opening between the fire and the second side wherein the opening accommodates a key ring. Further, the apparatus has a pre-formatted label card wherein the label card has a plurality of labels wherein the labels may be affixed to either of the first side or the second side of the tag.

In an embodiment, the apparatus has a key tag that is composed of plastic.

In an embodiment, the apparatus has a key tag that is composed of metal.

In an embodiment, that apparatus has a key tag wherein the first side of the key tag and the second side of the key tag are indented to receive the label.

In an embodiment, the apparatus has a second opening the tag between the first side and the second side wherein the second opening accommodates a key ring.

In an embodiment, the apparatus has preformed labels that are printed with information downloaded from a website.

In an embodiment, the apparatus has preformatted labels that are affixed to the key tag by an adhesive.

In an embodiment, the apparatus has preformatted labels that are printed by hand by an individual.

In an embodiment of the present invention a key tag labeling system is provided. The system has a key tag having a first opening to accommodate a key ring and a surface to accommodate a label. Further the system includes a label having a first side and a second side wherein the first side is adhesively secured to the key label and further wherein the second side of the label is printable thereon. The system also has a downloadable program for label preparation.

In an embodiment, the system has a key tag having a second opening on the tag wherein the second opening accommodates a key ring.

In an embodiment, the system has a label sheet having a plurality of preformed labels contained thereon for printing by a computer.

In an embodiment, the system has a printing means for printing information mechanically onto the labels.

In an embodiment, the system has a printing means for printing information manually onto the labels.

In an embodiment, the system has a program that includes custom formatted designs printable onto the labels.

In an embodiment, the system has a program that includes custom formatted insignia.

In an embodiment of the present invention, a method for labeling a key tag is provided. The method has the steps of:

providing a key tag having a first side and a second side wherein an opening is provided between the first side and the second side for accommodating a key ring; providing a label to identify the key; providing an indentation on at least one of the first side and the second side of the key tag for receiving the label; and providing downloadable software to support printing of information on the label.

In an embodiment, the method comprises the step of providing a label with a first side and a second side wherein the first side has an adhesive and the second side is printable thereon.

In an embodiment, the method comprises the step of printing information on the label.

In an embodiment, the method comprises the step of affixing the label to the key tag.

It is, therefore, an advantage of the present invention to provide an apparatus for labeling key tags, a system for labeling key tags and a method for using the same.

Another advantage of the present invention is to provide an apparatus and a method for using the same wherein the key tag is made of plastic.

Still another advantage of the present invention is to provide an apparatus and a method for using the same wherein the key tag is made of metal.

Another advantage of the present invention is to provide an apparatus and a method for using the same wherein the key tag is made of wood.

Yet another advantage of the present invention is to provide an apparatus for labeling key tags and a method for using the same wherein the key tag may have a plurality of openings for receipt of key rings.

Still another advantage of the present invention is to provide an apparatus for labeling key tags and a method for using the same wherein pre-formatted label cards are provided.

An advantage of the present invention is to provide an apparatus for labeling key tags and a method for using the same wherein pre-formatted label cards may be provided wherein the pre-formatted label cards may have a plurality of labels contained thereon.

Another advantage of the present invention is to provide an apparatus for labeling key tags and a method for using the same wherein the pre-formatted label cards may be affixed to the key tag.

Yet another advantage of the present invention is to provide an apparatus for labeling key tags and a method for using the same wherein the pre-formatted label cards may be printed by a mechanical device and/or may be printed manually by a individual.

Still another advantage of the present invention is to provide an apparatus for labeling key tags and a method for using the same wherein the key tag may have two sides that may accommodate a label.

Another advantage of the present invention is to provide an apparatus for labeling key tags and a method for using the same wherein the key tag may have two sides that may be indented for receipt of a label.

Yet another advantage of the present invention is to provide an apparatus for labeling key tags and a method for using the same wherein a mouthpiece may be uniquely configured to a regulator during use of the regulator.

Still another advantage of the present invention is to provide an apparatus and system for labeling key tags and a method for using the same wherein a program may be provided for downloading information to print on a label.

Another advantage of the present invention is to provide an apparatus for labeling key tags and a method for using the same wherein a program for printing on a label may be downloaded from a website.

Still another advantage of the present invention is to provide an apparatus for labeling key tags and a method for using the same wherein the key tags may have a oval design.

Another advantage of the present invention is to provide an apparatus for labeling key tags and a method for using the same wherein the key tags may have a rectangular design.

Yet another advantage of the present invention is to provide an apparatus for labeling key tags and a method for using the same wherein the key tags may have a circular design.

Still another advantage of the present invention is to provide an apparatus for labeling key tags and a method for using the same wherein the key tags may have a geometric design.

These and other objects of the invention will become more clear when one reads the following specification, taken together with the drawings that are attached hereto. The scope of protection sought by the inventors may be gleaned from a fair reading of the Claims that conclude this specification.

Additional features and advantages of the present invention are described in, and will be apparent from, the detailed description of the presently preferred embodiments and from the drawings.

DESCRIPTION OF THE PREFERRED EMBODIMENT

Figure 1A:
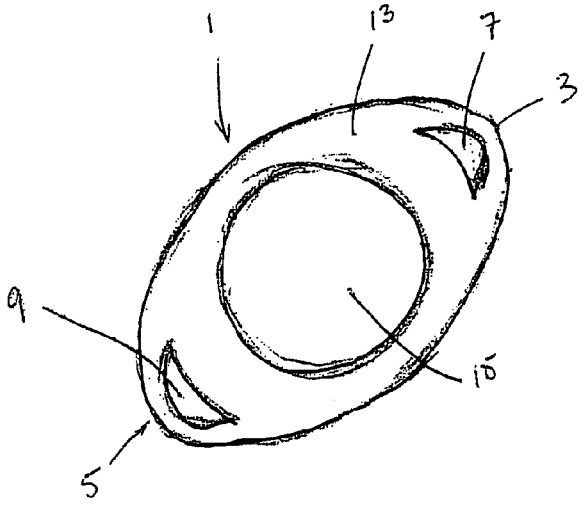
FIG. 1*a* is a perspective view of the key tag in an embodiment of the present invention.

Turning now to the drawings wherein elements are identified by numbers and like elements are identified by like numbers throughout the 3 figures, the invention is depicted in FIG. 1*a* that shows a key tag. As shown in FIG. 1*a*, the key tag 1 may be oval in shape and may have a first side 3 and a second side 5. The first side 3 may have a first opening 7. The first opening 7 may accommodate a key ring (not shown) for identifying a key (not shown). The second side 5 may have a second opening 9 which may be provided to accommodate a key ring (not shown) in order to identify a key (not shown). The first opening 7 and the second opening 9 may accommodate a key and/or a plurality of keys simultaneously. Alternatively, the second opening 9 may be used to hang the key on a hook and/or storage rack for identification and/or location. The key tag 1 may have a flat surface 13 that may be between the first side 3 and the second side 5. The flat surface 13 may accommodate a label 15. The label 15 may be affixed to the key tag 1 with an adhesive (not shown).

Figure 1B:
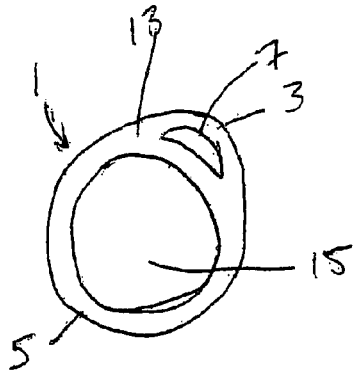
FIG. 1*b* is a perspective view of the key tag in an embodiment of the present invention.

FIG. 1*b* illustrates a key tag 1 having a oval shape and having a first side 3 and a second side 5. The first side 3 may have an opening 7. The opening 7 may be used to accommodate a key ring. FIG. 1*a* also illustrates a key tag 1 having a flat surface 13 that may accommodate a label 15.

Figure 2:
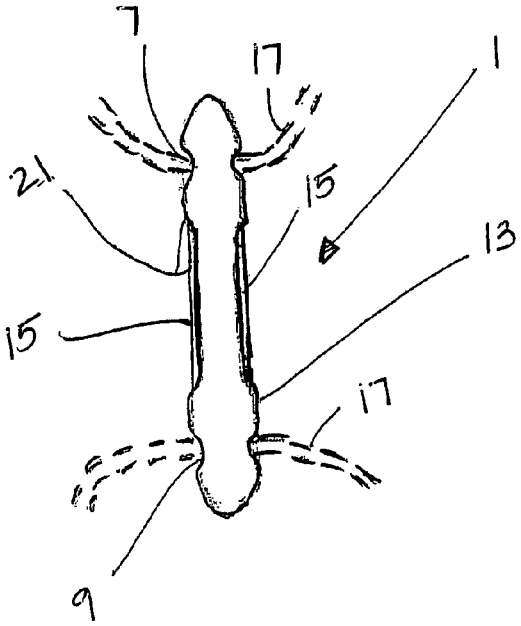
FIG. 2 is a side perspective view of the key tag in an embodiment of the present invention.

FIG. 2 illustrates a side view of the key tag 1 in an embodiment of the present invention. FIG. 2 further illustrates the key tag 1 that may have a first opening 7 and a second opening 9. The first opening 7 and the second opening 9 may accommodate a first key ring 15 and/or a second key ring 17. The key tag 1 may also have an indentation 21 which may receive a label 15. When a label 15 is received by the indentation 21 of the key tag 1, the key tag 1 may have a surface 13 that may be generally flat.

Figure 3:
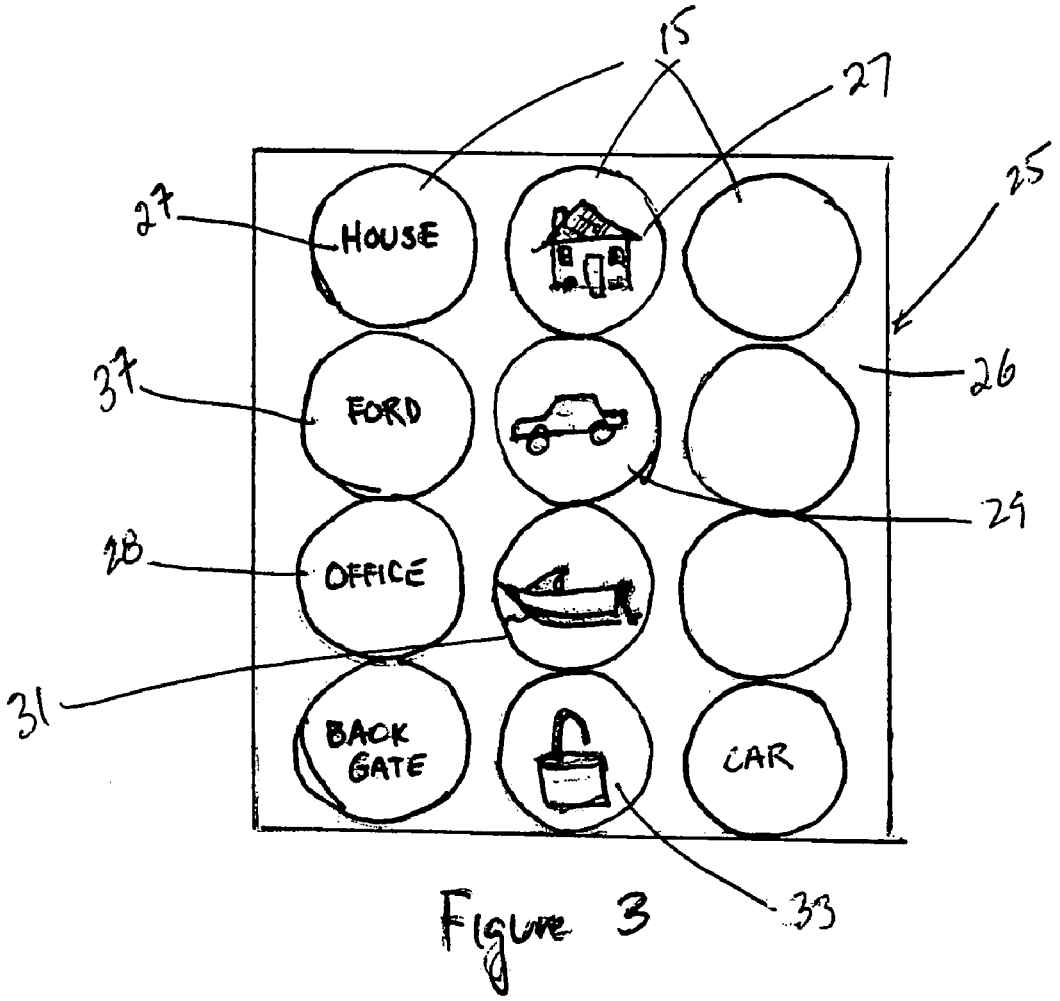
FIG. 3 is a perspective view of the label card in an embodiment of the present invention.
Figure 1A:
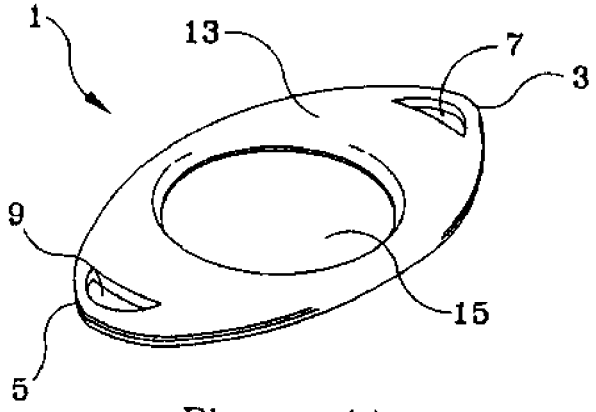
Figure 1B:
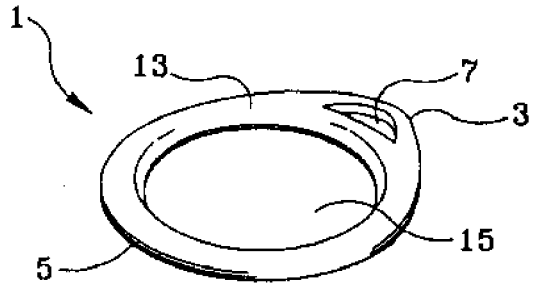
Figure 2:
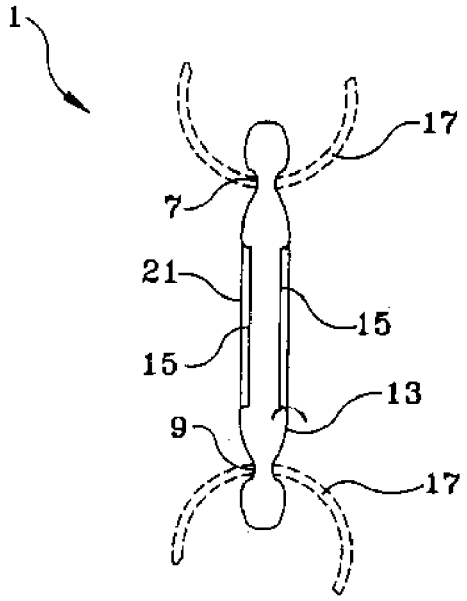
Figure 3:
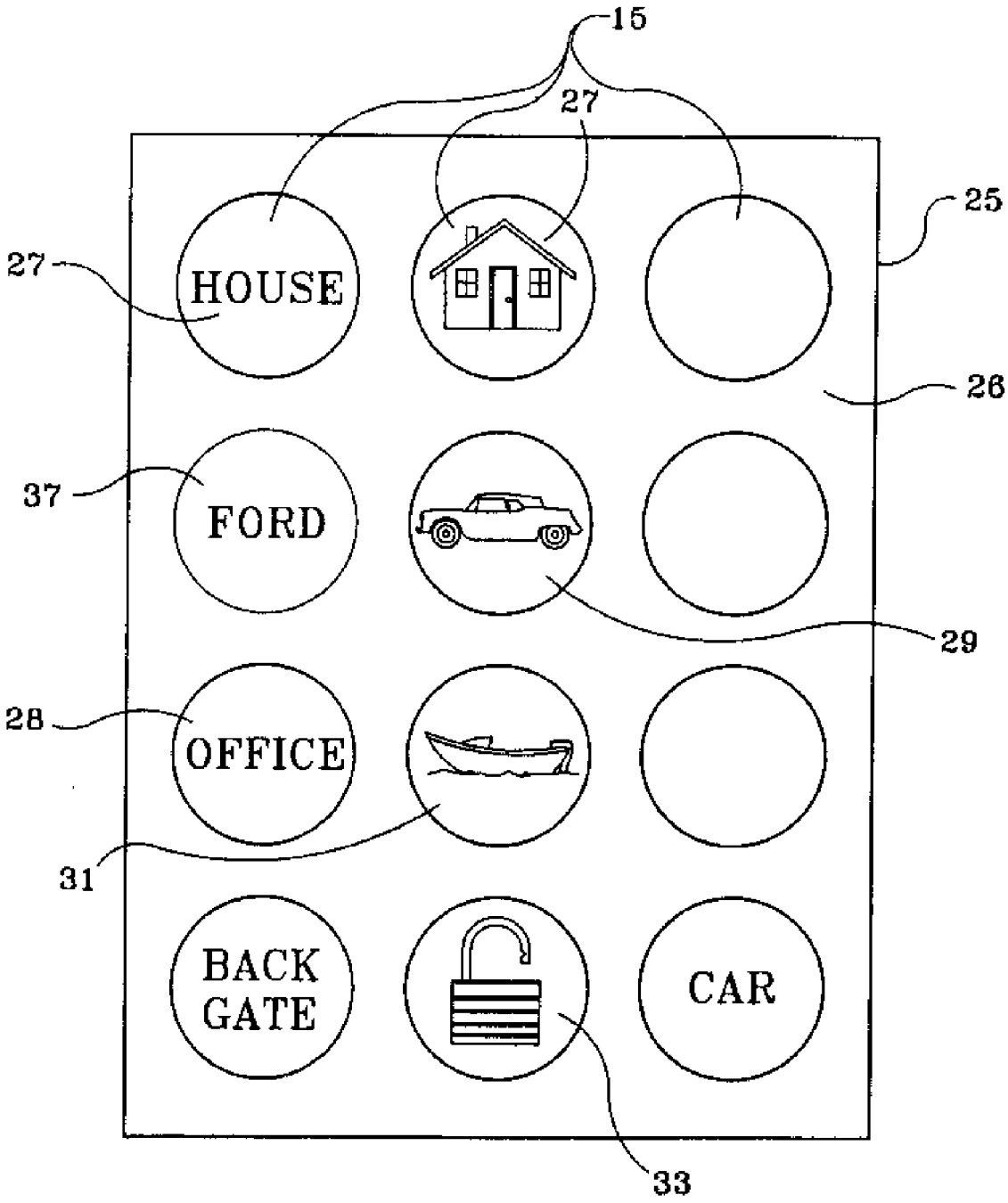
Figure 1A:
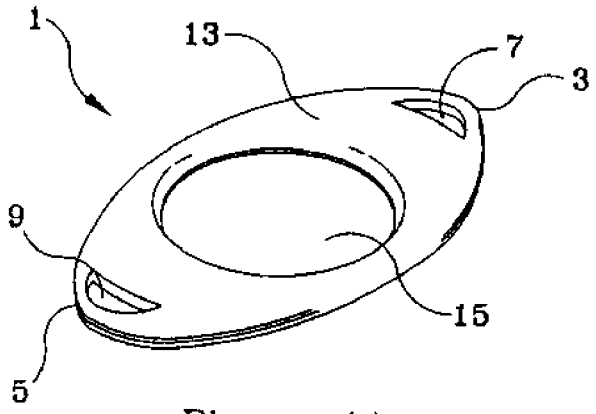
Figure 1B:
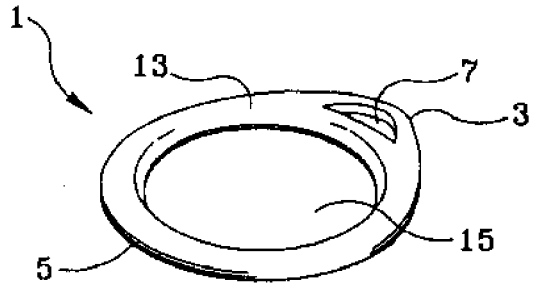
Figure 2:
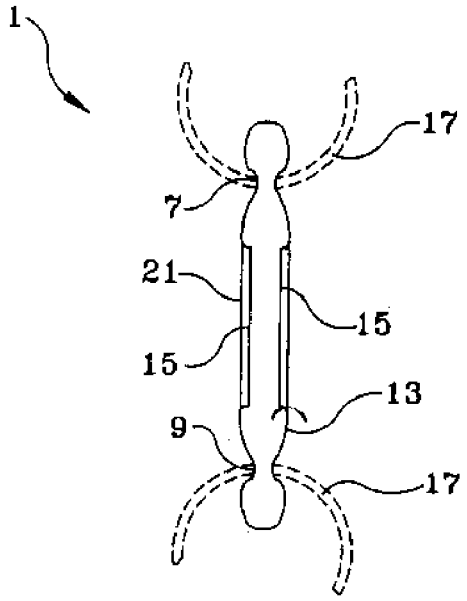
Figure 3:
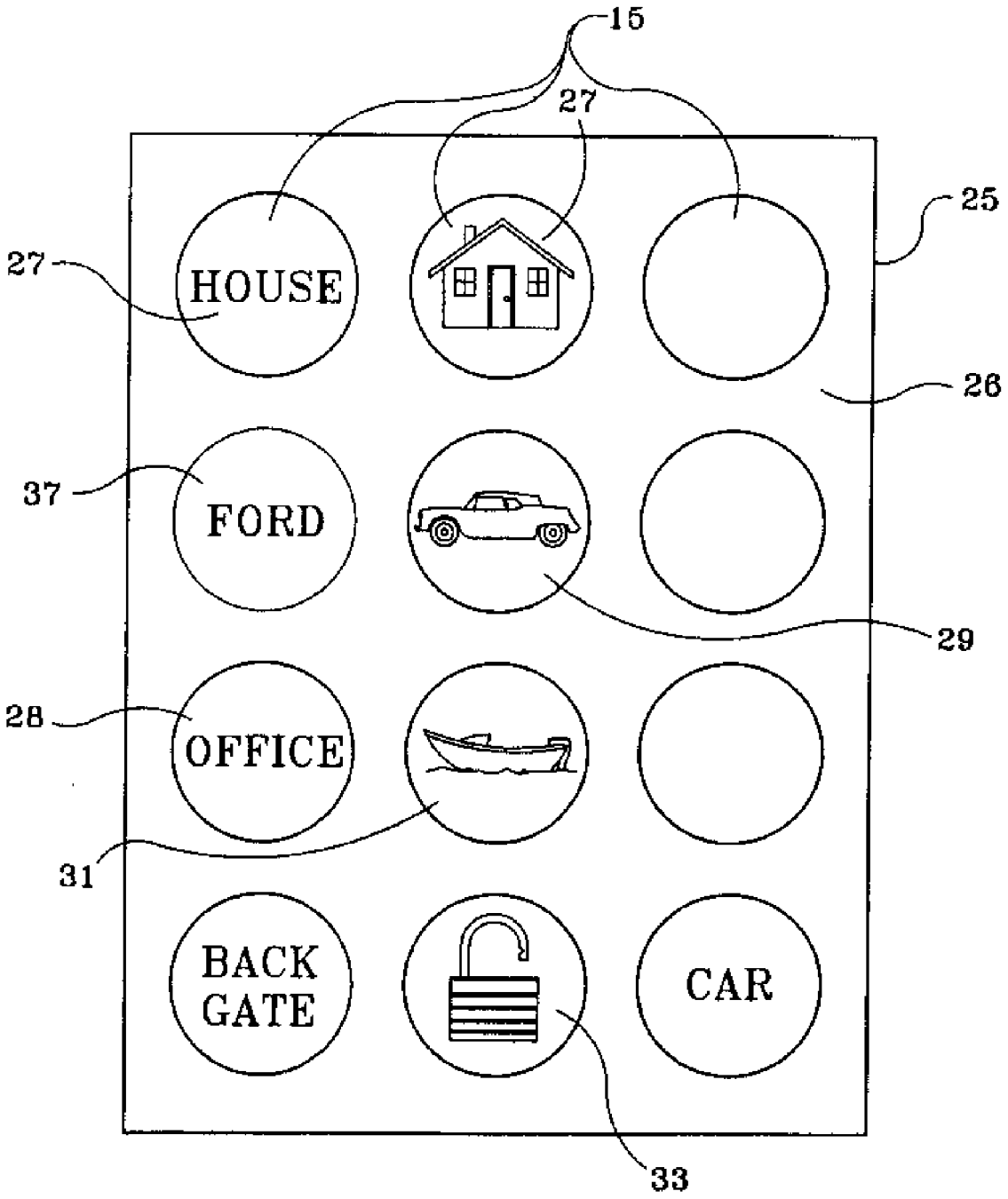

FIG. 3 illustrates a label card 25. The label card 25 may be pre-formatted for use by an individual (not shown). The label card 25 may have a plurality of labels 15 positioned thereon. Each label 15 may be used on a key tag 1 to identify the keys or plurality of keys contained on a key ring 15,17. The label 15 may have an adhesive thereon to be attached to the key tag 1. The label 15 may also have, for example, a paper side 26 for printing information relating to the identification of a key.

The label card 25 may be used in conjunction with a computer program that may be downloaded from a website. The computer program may have information advantageous to printing information onto the label 15. The computer program may have, for example, a list of commonly used key identifiers, such as, "HOUSE KEY", "CAR KEY", "BOAT KEY", and "OFFICE KEY" 28. The program may also contain illustrations and/or images, such as, for example, a house 27, a car 29, a boat 31, or a lock 33. The illustrations and/or pictures may be downloaded from a website and printed by a user onto the label 15. The label 15 may be extracted from the label card sheet 25 and applied to the key tag 1. The program may also provide a user with the ability to customize the information to be imprinted onto the label 15. A user may input a specific reference onto the label 15 such as, for example, "FORD" 37. After input of the specific reference, the label 15 may be printed with the specific information and removed from the label card sheet 25 and placed onto the key tag 1. The label 15 may be printed by a computer, or may be manually printed by an individual.

It should be understood that various changes and modifications to the presently preferred embodiments described herein will be apparent to those skilled in the art. Such changes and modifications may be made without departing from the spirit and scope of the present invention and without diminishing its attendant advantages.

What is claimed is:

1. An apparatus for labeling keys, the apparatus comprising:

a unitary key tag having a first side and a second side wherein the first side and the second side are in opposed, spaced-apart arrangement wherein the first side and the second side accommodate a label thereto wherein said first side and second side have a recess thereon to allow for vertical disengagement of the label therefrom wherein the recess is enclosed by a raised rim portion;

at least one opening formed in said key tag and passing through the first side and the second side wherein the opening is integrally formed on the key tag and further wherein said opening accommodates a key ring and further wherein said first side and said second side being part of a single piece unit ; and a pre-formatted label card wherein the label card has a plurality of labels contained thereon wherein the labels are removed from the label card and are affixed directly onto either of the first side or the second side of the tag.

2. The apparatus of claim 1 wherein the key tag is composed of plastic.

3. The apparatus of claim 1 wherein the key tag is composed of metal.

4. The apparatus of claim 1 further comprising:

a second opening in the tag between the first side and the second side wherein the second opening accommodates a key ring.

5. The apparatus of claim 1 wherein the pre-formatted labels are printed with information downloaded from a website.

6. The apparatus of claim 1 wherein the pre-formatted labels are affixed to the key tag by an adhesive.

7. The apparatus of claim 1 wherein the pre-formatted labels are printed by hand by an individual.

8. A key tag labeling system comprising:

a key tag device having a first opening integrally positioned thereon to accommodate a key ring and a first surface and a second surface wherein the first and second surfaces having an exposed surface, a continuous rim portion and a recess thereon wherein the recess provides for receipt of a label wherein said key tag device is a single piece unit wherein said recess further allows for vertical disengagement of a label therefrom;

a label having a first side and a second side wherein the first side is adhesively secured to the key label first and second surfaces and further wherein the second side of the label is printable thereon; and a downloadable program for label preparation.

9. The key tag labeling system of claim 8, further comprising:

a key tag having a second opening on the tag wherein the second opening accommodates a key ring.

10. The key tag labeling system of claim 8 wherein a card label sheet has a plurality of pre-formatted labels contained thereon for printing by a computer.

11. The key tag system of claim 8 wherein the labels are printed manually by an individual.

12. The key tag system of claim 8 wherein the software program includes custom formatted designs printable onto the labels.

13. The key tag system of claim 8 wherein the software program includes custom formatted images.

14. A method for labeling a key, the method comprising the steps of:

providing a key tag having a first side and a second side and an opening formed in the key tag and passing through the first side and the second side for accommodating a key ring wherein the opening is integrally formed in association with the first side and the second side of the key tag as being part of a single piece unit;

providing a label to identify the key;

providing a recess and an outer rim which encloses the recess on at least one of the first side and the second side of the key tag for receiving the label wherein said recess allows for vertical disengagement of a label from said recess; and providing downloadable software to support printing of information on the label.

15. The method of claim 14, further comprising the step of:

providing a second opening for accommodating a key ring.

16. The method of claim 14, further comprising the step of:

providing a label with a first side and a second side wherein the first side has an adhesive and the second side is printable thereon.

17. The method of claim 14, further comprising the step of:

printing information on the label.

18. A method of claim 14, further comprising the step of: affixing the label to the key tag.

* * * * *

UNITED STATES PATENT AND TRADEMARK OFFICE

CERTIFICATE OF CORRECTION

PATENT NO. : 7,228,652 B2
APPLICATION NO. : 11/345086
DATED : June 12, 2007
INVENTOR(S) : Raymond Howard It is certified that error appears in the above-identified patent and that said Letters Patent is hereby corrected as shown below:

ABSTRACT:
Line 6, “identifying” should read --identify--.

Drawings:
Page 1/2, replace drawing sheet as attached.
Page 2/2, replace drawing sheet as attached.

Column 1:
Line 8, delete the phrase “of a”.
Line 18, “care” should read --carry--.
Line 29, delete the phrase “might be”.

Column 3:
Line 50, delete the word “a” should read --an--.
Line 62, delete the phrase “wherein a mouthpiece may be uniquely”.
Line 63, delete the phrase “configured to a regulator during use of the regulator.”

Column 4:
Line 7, delete the word “a” should read --an--.

Signed and Sealed this

Eighteenth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,228,652 B2
APPLICATION NO. : 11/345086
DATED : June 12, 2007
INVENTOR(S) : Raymond Howard It is certified that error appears in the above-identified patent and that said Letters Patent is hereby corrected as shown below:

Delete title page and substitute therefor the attached title page.

ABSTRACT:
Line 6, "identifying" should read --identify--.

Drawings:
Page 1/2, replace drawing sheet as attached.
Page 2/2, replace drawing sheet as attached.

Column 1:
Line 8, delete the phrase "of a".
Line 18, "care" should read --carry--.
Line 29, delete the phrase "might be".

Column 3:
Line 50, delete the word "a" should read --an--.
Line 62, delete the phrase "wherein a mouthpiece may be uniquely".
Line 63, delete the phrase "configured to a regulator during use of the regulator."

Column 4:
Line 7, delete the word "a" should read --an--.

This certificate supersedes the Certificate of Correction issued December 18, 2007.

Signed and Sealed this

Fifteenth Day of April, 2008

JON W. DUDAS
*Director of the United States Patent and Trademark Office*

(12) United States Patent
Howard

(10) Patent No.: US 7,228,652 B2
(45) Date of Patent: Jun. 12, 2007

(54) LABELED KEY TAGS

(76) Inventor: Raymond Howard, 7890 Dunbrook Rd., San Diego, CA (US) 92126

( * ) Notice: Subject to any disclaimer, the term of this patent is extended or adjusted under 35 U.S.C. 154(b) by 0 days.

(21) Appl. No.: 11/345,086

(22) Filed: Jan. 31, 2006

(65) Prior Publication Data

US 2006/0150455 A1 Jul. 13, 2006

Related U.S. Application Data

(62) Division of application No. 10/627,021, filed on Jul. 25, 2003.

(51) Int. Cl.
*A44B 15/00* (2006.01)

(52) U.S. Cl. ..... 40/634; 40/638

(58) Field of Classification Search ..... 40/323, 40/633, 634, 653

See application file for complete search history.

(56) References Cited

U.S. PATENT DOCUMENTS

| | | | | | |
|---|---|---|---|---|---|
| 653,267 | A * | 7/1900 | Short | | 40/634 |
| 944,744 | A * | 12/1909 | Pine | | 40/323 |
| 964,228 | A * | 7/1910 | Fowler | | 40/634 |
| 1,505,838 | A * | 8/1924 | Withrow | | 40/634 |
| 1,711,736 | A * | 5/1929 | Lorber | | 40/634 |
| 1,714,421 | A * | 5/1929 | Goldworthy | | 40/634 |
| 2,181,796 | A * | 11/1939 | Williams, Jr. | | 40/634 |
| 2,357,641 | A * | 9/1944 | Evalt | | 40/634 |
| 2,842,877 | A * | 7/1958 | Stevens | | 40/634 |
| 3,589,155 | A * | 6/1971 | Kamp | | 70/459 |
| 4,235,459 | A * | 11/1980 | Callahan | | 40/634 |
| 4,521,981 | A * | 6/1985 | Kasprzycki et al. | | 40/634 |
| 5,617,751 | A * | 4/1997 | Song | | 40/634 |
| 6,244,763 | B1 * | 6/2001 | Miller | | 400/76 |

* cited by examiner

*Primary Examiner*—Lars A. Olson
(74) *Attorney, Agent, or Firm*—Hani Z. Sayed, Esq.; Rutan & Tucker, LLP

(57) ABSTRACT

A labeled key tag, key tag system and method for using the system is provided. The key tag system may be used to identify the keys that may be attached thereto. The system provides a key tag having a labeling system for downloading, printing and affixing a label to a key tag. The system allows the key tag to identifying keys on a key ring with respect to each other.

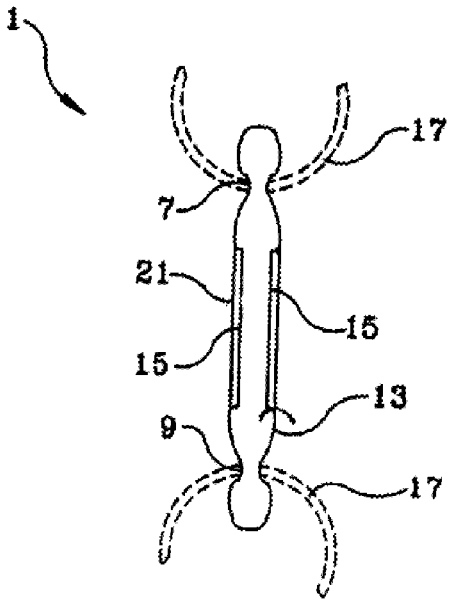

18 Claims, 2 Drawing Sheets